US011536469B2

(12) United States Patent
Si et al.

(10) Patent No.: US 11,536,469 B2
(45) Date of Patent: Dec. 27, 2022

(54) SADDLE-TYPE WINDOW AIR CONDITIONER

(71) Applicants: QINGDAO HAIER AIR CONDITIONER GENERAL CORP., LTD., Shandong (CN); HAIER SMART HOME CO., LTD., Shandong (CN)

(72) Inventors: Chuanling Si, Qingdao (CN); Guangbao Qiao, Qingdao (CN); Ruofeng Wang, Qingdao (CN); Qiang Zhang, Qingdao (CN); Wenquan Song, Qingdao (CN); Yanfei Wang, Qingdao (CN); Luyan Liu, Qingdao (CN)

(73) Assignees: QINGDAO HAIER AIR CONDITIONER GENERAL CORP., LTD., Shandong (CN); HAIER SMART HOME CO., LTD., Shandong (CN)

( * ) Notice: Subject to any disclaimer, the term of this patent is extended or adjusted under 35 U.S.C. 154(b) by 0 days.

(21) Appl. No.: 17/609,722

(22) PCT Filed: Mar. 16, 2020

(86) PCT No.: PCT/CN2020/079537
§ 371 (c)(1),
(2) Date: Nov. 8, 2021

(87) PCT Pub. No.: WO2020/224328
PCT Pub. Date: Nov. 12, 2020

(65) Prior Publication Data

US 2022/0146121 A1 May 12, 2022

(30) Foreign Application Priority Data

May 9, 2019 (CN) ..... 201910384881.4

(51) Int. Cl.
*F24F 1/027* (2019.01)
*F24F 13/24* (2006.01)

(52) U.S. Cl.
CPC ..... *F24F 1/027* (2013.01); *F24F 13/24* (2013.01); *F24F 2013/247* (2013.01)

(58) Field of Classification Search
CPC ..... F24F 1/027; F24F 2013/247; F24F 13/24
See application file for complete search history.

(56) References Cited

U.S. PATENT DOCUMENTS 5,167,131 A * 12/1992 Karkhanis ..... F24F 1/027 62/262
5,295,903 A * 3/1994 Bolton ..... F24F 1/027 454/203

(Continued)

FOREIGN PATENT DOCUMENTS

CN 101876466 A 11/2010
CN 101876468 A 11/2010

(Continued)

OTHER PUBLICATIONS

WO-2009071341-A1 Translation (Year: 2009).*

(Continued)

*Primary Examiner* — Schyler S Sanks
(74) *Attorney, Agent, or Firm* — Alston & Bird LLP

(57) ABSTRACT

A saddle-type window air conditioner comprises an indoor part, an outdoor part and a connecting part. The connecting part includes an indoor connecting box and an outdoor connecting box sleeved in each other. The indoor connecting box is connected with the indoor part, the outdoor connecting box is connected with the outdoor part, and the connecting part is provided with locking assemblies. Each of the locking assemblies includes a lock sleeve, a lock core, a push button and a rack. The lock sleeve is disposed on the indoor connecting box located on an outer side or on the (Continued)

outdoor connecting box, and is provided with a lock hole; the rack is disposed on the outdoor connecting box located on an inner side or on the indoor connecting box; the push button is connected with the lock core and configured to push the lock core to move; and the lock core is provided with a lock pillar. When the lock pillar is clamped and locked with the lock hole, the lock core is separated from the rack to extend or shorten the connecting part. When the lock pillar is separated from the lock hole, the lock core is clamped with the rack, and the connecting part cannot be extended, but can only be shortened under the action of an external force to realize the locking of the connecting part.

12 Claims, 6 Drawing Sheets

(56) References Cited

U.S. PATENT DOCUMENTS

| | | | | |
|---|---|---|---|---|
| 6,568,201 | B1 * | 5/2003 | Cur | F24F 1/027 62/262 |
| 6,607,221 | B1 * | 8/2003 | Elliott | E05C 9/043 49/446 |
| 7,350,759 | B1 * | 4/2008 | Gray | F24F 1/027 248/644 |
| 9,982,909 | B1 * | 5/2018 | Perez | F24F 13/32 |
| 2003/0110789 | A1 | 6/2003 | Cur et al. | |
| 2007/0068185 | A1 * | 3/2007 | Thompson | F24F 1/027 62/262 |
| 2013/0180296 | A1 * | 7/2013 | McEachern | E05C 17/48 292/300 |
| 2014/0020421 | A1 * | 1/2014 | Gallo | B23P 11/00 62/263 |
| 2014/0284182 | A1 * | 9/2014 | Kuo | B65G 13/12 198/782 |
| 2017/0284683 | A1 * | 10/2017 | Gallo | F24F 13/0245 |
| 2020/0217521 | A1 * | 7/2020 | Lundstrom | F24F 1/0003 |

FOREIGN PATENT DOCUMENTS

| | | | | |
|---|---|---|---|---|
| CN | 101965110 | A * | 2/2011 | |
| CN | 204245330 | U * | 4/2015 | |
| CN | 206086020 | U | 4/2017 | |
| CN | 210320347 | U | 4/2020 | |
| KR | 20050116217 | A | 12/2005 | |
| WO | WO-2007050998 | A2 * | 5/2007 | F24F 1/0003 |
| WO | WO-2008077740 | A2 * | 7/2008 | F25D 23/04 |
| WO | WO-2009071341 | A1 * | 6/2009 | F25D 23/04 |

OTHER PUBLICATIONS

CN-204245330-U Translation (Year: 2015).*
CN-101965110-A Translation (Year: 2011).*
WO-2008077740-A2 Translation (Year: 2008).*
Written Opinion of the International Searching Authority for PCT/CN2020/079537 (ISA/CN) dated Jun. 3, 2020 (10 pages).
International Search Report for PCT/CN2020/079537 (ISA/CA) dated Jun. 3, 2020 with English translation (4 pages).

* cited by examiner

SADDLE-TYPE WINDOW AIR CONDITIONER

CROSS-REFERENCE TO RELATED APPLICATIONS

The present application is a national phase entry of International Application No. PCT/CN2020/079537, filed Mar. 16, 2020, which claims priority to Chinese Patent Application No. 201910384881.4, filed May 9, 2019, which are incorporated herein by reference in their entirety.

FIELD OF THE INVENTION

The present invention relates to the technical field of air conditioners, and particularly relates to a saddle-type window air conditioner.

BACKGROUND OF THE INVENTION

At present, most of window type air conditioners on the market are square and belong to integrated air conditioners. The window type air conditioner is composed of a chassis, a housing, a panel, an air duct, an indoor fan, an outdoor fan, a motor, a compressor, a condenser, an evaporator, etc. After the window type air conditioner is installed, the sunlight shading height is about the total height of the window type air conditioner, so that customers cannot enjoy sufficient sunlight. Since the outdoor part and the indoor part of the window type air conditioner are integrated, the noise generated by the outdoor part will also be transmitted to the indoor part, which causes very loud noise and affects the comfort level of customers. Therefore, the window type air conditioner cannot be applied to customers who are sensitive to noise.

In order to solve this problem, a saddle-type window air conditioner came into being, and it mainly includes an indoor part and an outdoor part. The indoor part is separated from the outdoor part, that is, the indoor is separated from the outdoor, which effectively reduces the indoor noise. The indoor part mainly includes a panel, a housing, a chassis, an evaporator, a cross-flow fan, a motor, an air duct, an electrical control assembly, and other components. The outdoor part mainly includes a housing, a chassis, a compressor, a condenser, a pipeline, a motor, a motor bracket, an axial-flow fan, and other components. The indoor part is connected with the outdoor part through a connecting part, the connecting part has a retractable mode, and the saddle-type window air conditioner can adapt to windows of different sizes by adjusting the length of the connecting part. How to realize fastening and positioning of the connecting part during installation of the saddle-type window air conditioner and after installation and positioning of the saddle-type window air conditioner, so that the connecting part can be maintained at a fixed length when the length is not required to be adjusted, is a problem to be solved by those skilled in the art.

The above information disclosed in the background art is only used to better understand the background art of the present application, and therefore, it may include the content that does not constitute the prior art known to those of ordinary skill in the art.

BRIEF DESCRIPTION OF THE INVENTION

In order to solve the above technical problems, the present invention provides a saddle-type window air conditioner, which realizes the locking of a connecting part by disposing locking assemblies. The saddle-type window air conditioner is simple in structure and easy to operate.

The technical solution provided by the present invention is a saddle-type window air conditioner, including an indoor part located on an indoor side, an outdoor part located on an outdoor side, and a connecting part disposed between the indoor part and the outdoor part. The connecting part includes an indoor connecting box and an outdoor connecting box sleeved in each other, the indoor connecting box is connected with the indoor part, the outdoor connecting box is connected with the outdoor part, and the indoor connecting box and the outdoor connecting box move relative to each other. The saddle-type window air conditioner further includes locking assemblies, wherein each of the locking assemblies includes: a lock sleeve, disposed on the indoor connecting box located on an outer side or on the outdoor connecting box, and provided with a lock hole; a lock core, provided with a lock pillar clamped and locked with the lock hole; a push button, connected with the lock core and configured to push the lock core to move; and a rack, disposed on the outdoor connecting box located on an inner side or on the indoor connecting box. When the lock pillar is clamped and locked with the lock hole, the lock core is separated from the rack. When the lock pillar is separated from the lock hole, the lock core is clamped with the rack.

As a preferred solution, the lock core further includes a push button connecting part and a rack clamping part respectively disposed at two ends of the lock pillar, the push button connecting part is connected with the push button, and the rack clamping part is clamped with the rack.

Further, the push button connecting part is provided with openings; and the push button includes a hand push part and insertion parts, clamping hooks are disposed at free ends of the insertion parts, the insertion parts are inserted into the openings, and the clamping hooks are clamped with the openings.

Further, the clamping hooks abut against the lock sleeve.

As a preferred solution, the rack clamping part is provided with a plane part, and the plane part abuts against the rack.

Further, the rack has a plurality of saw teeth arranged in sequence, each of the saw teeth includes a stop part and an arc part, and the plane part abuts against the stop part.

As a preferred solution, the lock sleeve further includes a lock core accommodating cavity communicated with the lock hole, and when the lock pillar is clamped and locked with the lock hole, one end of the rack clamping part is disposed in the lock core accommodating cavity.

Further, a spring is further disposed in the lock core accommodating cavity.

As a preferred solution, the connecting part further includes a decorative cover, the decorative cover is connected with the indoor part and is provided with through holes, the insertion parts pass through the through holes and are clamped with the openings, and the hand push part is located on an outer side of the decorative cover.

As a preferred solution, two locking assemblies are provided and are arranged at an interval along a width direction of the connecting part.

Compared with the prior art, the present invention has the following advantages and positive effects:

The present invention provides a saddle-type window air conditioner. Locking assemblies are disposed on a connecting part having an adjustable length. Each of the locking assemblies includes a lock sleeve, a lock core, a push button and a rack, the lock sleeve is disposed on an indoor connecting box located on the outer side or on an outdoor connecting box, the rack is disposed on the outdoor connecting box located on the inner side or on the indoor connecting box, and the push button is connected with the lock core and configured to push the lock core to move. When the lock core is clamped and locked with the lock sleeve, the indoor connecting box and the outdoor connecting box can move relative to each other, so that the connecting part can be extended or shortened. When the lock core is separated from the lock sleeve, the indoor connecting box and the outdoor connecting box cannot move away from each other and can only move towards each other under the action of an external force, so as to realize the locking of the connecting part. The locking assembly is simple in structure and easy to operate.

After reading the specific implementation manners of the present invention in conjunction with the accompanying drawings, other features and advantages of the present invention will become clearer.

BRIEF DESCRIPTION OF THE DRAWINGS

To describe the technical solutions in the embodiments of the present invention or in the prior art clearly, the following briefly describes the accompanying drawings required for describing the embodiments or the prior art. Apparently, the accompanying drawings in the following description show some embodiments of the present invention, and those of ordinary skill in the art may still derive other drawings from these accompanying drawings without creative efforts.

In the figures: 100 denotes an outdoor part, 200 denotes an indoor part, 300 denotes a connecting part, 310 denotes an indoor connecting box, 320 denotes an outdoor connecting box, 321 denotes a flanging, 330 denotes a sliding rail, 340 denotes a decorative cover, 341 denotes a through hole, 400 denotes a locking assembly, 410 denotes a push button, 411 denotes a hand push part, 412 denotes an insertion part, 4121 denotes a clamping hook, 420 denotes a lock sleeve, 421 denotes a lock hole, 422 denotes a lock core accommodating cavity, 430 denotes a lock core, 431 denotes a lock pillar, 432 denotes a push button connecting part, 4321 denotes an opening, 433 denotes a rack clamping part, 4331 denotes a first end of the rack clamping part, 4332 denotes a second end of the rack clamping part, 4333 denotes a plane part, 440 denotes a spring, 450 denotes a rack, 451 denotes a saw tooth, 4511 denotes a stop part, 4512 denotes an arc part;

L denotes a length direction of the connecting part, and W denotes a width direction of the connecting part.

DETAILED DESCRIPTION

In order to make objectives, technical solutions and advantages of the embodiments of the present invention clearer, the technical solutions in the embodiments of the present invention are clearly and completely described below in conjunction with the accompanying drawings in the embodiments of the present invention, and it is apparent that the described embodiments are parts of embodiments rather than all embodiments of the present invention. All other embodiments obtained by those of ordinary skill in the art based on the embodiments of the present invention without creative efforts shall fall within the protection scope of the present invention.

It should be noted that in the descriptions of the present invention, the terms "upper", "lower", "left", "right", "vertical", "horizontal" "inner", "outer" and the like indicating the direction or position relationship are based on the direction or position relationships shown in accompanying drawings. These terms are only for the convenience of description, and do not indicate or imply that the device or element must have a specific orientation and must be constructed and operated in the specific orientation, so that these terms cannot be understood as a limitation to the present invention. In addition, the terms "first" and "second" are only used for description, and cannot be understood as indicating or implying relative importance.

Figure 1:
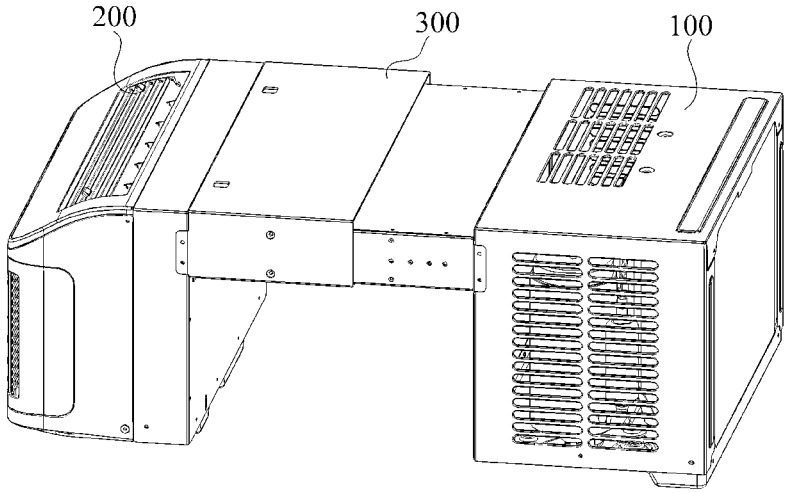
FIG. 1 is a schematic structural view of an embodiment of a saddle-type window air conditioner according to the present invention.
Figure 2:
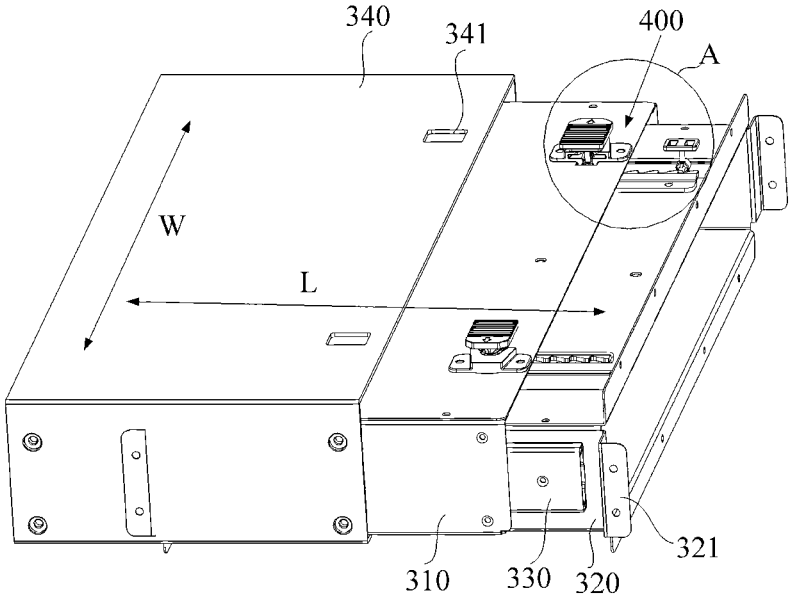
FIG. 2 is schematic structural view I of an embodiment of a connecting part according to the present invention.

The present invention discloses a saddle-type window air conditioner. Referring to FIG. 1 and FIG. 2, the saddle-type window air conditioner includes an indoor part 200, an outdoor part 100 and a connecting part 300. The connecting part 300 is configured to connect the indoor part 200 together with the outdoor part 100, the indoor part 200 is located on an indoor side, and the outdoor part 100 is located on an outdoor side. The indoor part 200 is separated from the outdoor part 100 by the connecting part 300, thereby effectively reducing the indoor noise. Furthermore, the indoor part 200 and the outdoor part 100 are located on the same side of the connecting part 300. After the window type air conditioner is installed, the connecting part 300 is located on a window, and the indoor part 200 and the outdoor part 100 are respectively located below the window, thereby preventing the sunlight from being blocked and improving the comfort level of users.

The connecting part 300 includes an indoor connecting box 310 and an outdoor connecting box 320 sleeved in each other. The indoor connecting box 310 is connected with the indoor part 200, and the outdoor connecting box 320 is connected with the outdoor part 100. Sliders are disposed between the indoor connecting box 310 and the outdoor connecting box 320. The indoor connecting box 310 and the outdoor connecting box 320 reciprocate along the sliders, so that the length of the connecting part 300 can be adjusted to facilitate installation. In the present embodiment, the sliders are disposed on the left and right sides of the indoor connecting box 310 and the outdoor connecting box 320. Of course, in other embodiments, the sliders may also be disposed on the upper and lower sides of the indoor connecting box 310 and the outdoor connecting box 320.

The installation steps of the saddle-type window air conditioner are as follows:

the connecting part 300 is stretched to the longest size;

the saddle-type window air conditioner is placed on a window, the connecting part 300 abuts against a window frame, the indoor part 200 is located on the indoor side, and the outdoor part 100 is located on the outdoor side; and the size of the connecting part 300 is shortened, so that the indoor part 200 abuts against the wall on the indoor side, and the outdoor part 100 abuts against the wall on the outdoor side.

The indoor connecting box 310 may be located on the outer side of the outdoor connecting box 320, and may also be located on the inner side of the outdoor connecting box 320. As a preferred embodiment, the indoor connecting box 310 is disposed on the outer side of the outdoor connecting box 320. In this way, after the window type air conditioner is installed, users cannot see the sliders between the indoor connecting box 310 and the outdoor connecting box 320 easily from the indoor side, so that the product is more beautiful.

Figure 9:
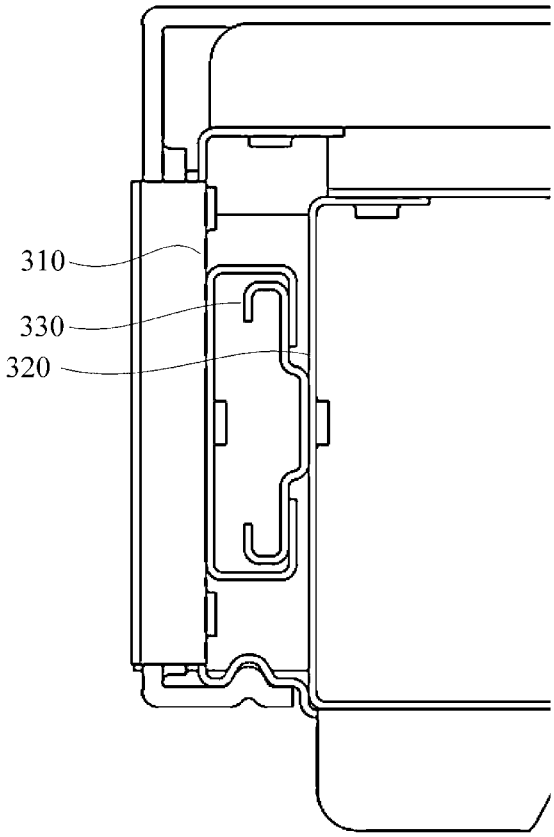
FIG. 9 is schematic structural view II of an embodiment of a connecting part according to the present invention.

There are two ways to realize the sliders. The first one is: referring to FIG. 2 and FIG. 9, the sliders adopt finished sliding rails 330 that can be purchased on the market; one side of the sliding rail 330 is fixedly connected with the inner side wall of the indoor connecting box 310, and the other side of the sliding rail 330 is fixedly connected with the outer side wall of the outdoor connecting box 320; and the indoor part 200 or the outdoor part 100 can be dragged to enable the indoor connecting box 310 and the outdoor connecting box 320 to move relative to each other along the sliding rails 330, so as to adjust the length of the connecting part 300. The second one is: the slider includes a guide groove and a guide rail (not shown in the figures) that reciprocates along the guide groove; the guide grooves are fixedly disposed on the inner side wall of the indoor connecting box 310, and the guide rails are fixedly disposed on the outer side wall of the outdoor connecting box 320; and the indoor part 200 or the outdoor part 100 can be dragged to enable the guide rails to slide along the guide grooves, and then enable the indoor connecting box 310 and the outdoor connecting box 320 to move relative to each other, so as to adjust the length of the connecting part 300. In the present embodiment, the sliders adopt sliding rails 330.

A decorative cover 340 is fixedly disposed on the outer side of the indoor connecting box 310 by means of screws or inserting, etc., and the decorative cover 340 is fixedly connected with the indoor part 200 by means of screws or welding, etc. The decorative cover 340 shields the indoor connecting box 310, the outdoor connecting box 320, the sliders, etc., so that the product is more beautiful.

Figure 3:
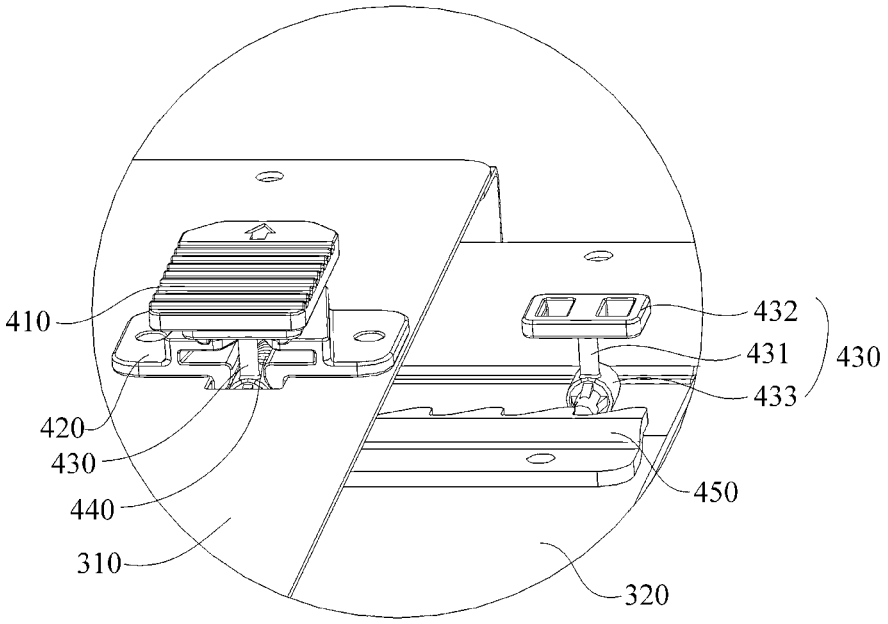
FIG. 3 is an enlarged view of part A in FIG. 2.
Figure 4:
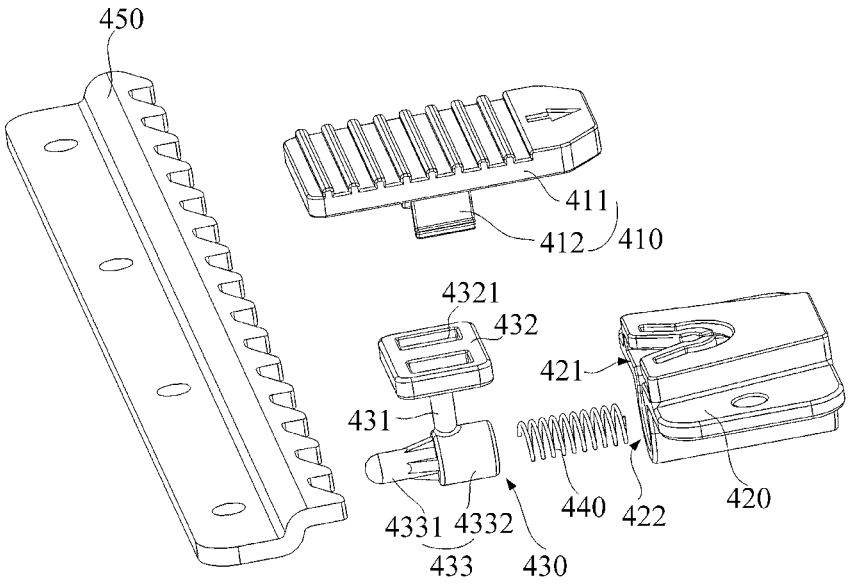
FIG. 4 is a schematic view of an exploded structure of an embodiment of a locking assembly according to the present invention.
Figure 12:
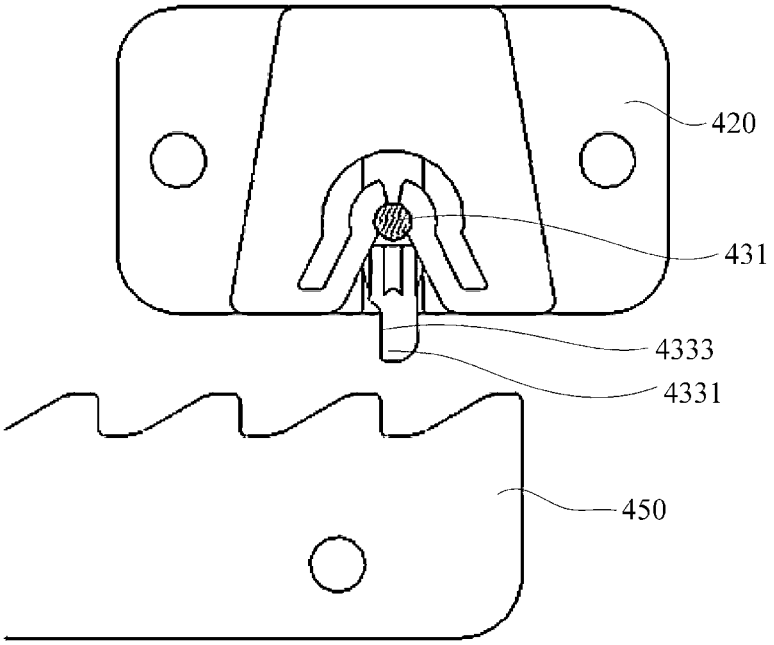
FIG. 12 is a schematic structural view of an embodiment of a locking assembly in a locked state according to the present invention.
Figure 13:
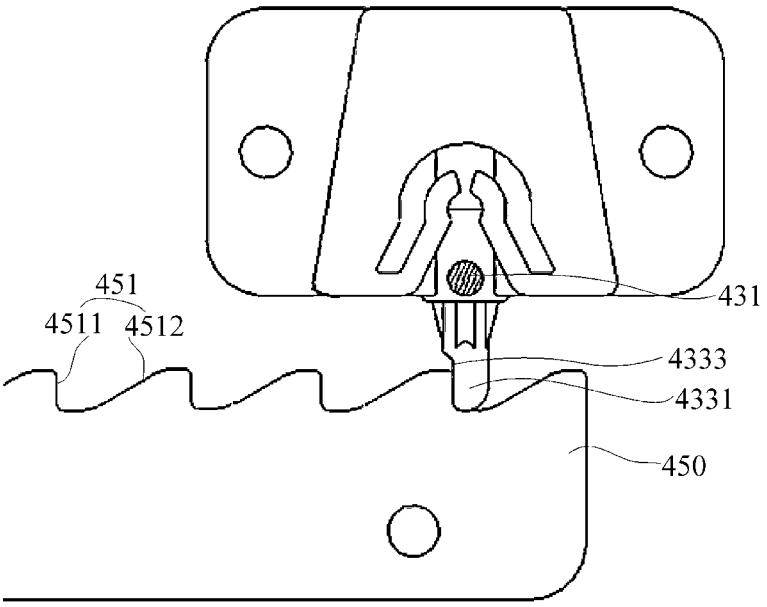
FIG. 13 is a schematic structural view of an embodiment of a locking assembly in a free state according to the present invention.

The saddle-type window air conditioner further includes locking assemblies 400. Referring to FIG. 2 to FIG. 4, in FIG. 2, in order to facilitate the understanding of a matching structure between the locking assemblies 400 and the connecting part 300, a push button 410 is disengaged from a through hole 341, and at the same time, the matching between a lock core 430 and a rack 450 is shown. The locking assembly 400 includes a lock sleeve 420, a lock core 430, a push button 410 and a rack 450. The lock sleeve 420 is disposed on the indoor connecting box 310 located on the outer side or on the outdoor connecting box 320, and it is provided with a lock hole 421. The rack 450 is disposed on the outdoor connecting box 320 located on the inner side or on the indoor connecting box 310. The push button 410 is connected with the lock core 430, and is configured to push the lock core 430 to move. The lock core 430 is provided with a lock pillar 431, and the lock pillar 431 is clamped and locked with the lock hole 421. When the lock pillar 431 is clamped and locked with the lock hole 421, this state is defined as a locked state of the locking assembly 400. Referring to FIG. 12, the lock core 430 is separated from the rack 450, and the indoor connecting box 310 and the outdoor connecting box 320 can move relative to each other, so that the connecting part 300 can be extended or shortened. When the lock pillar 431 is separated from the lock hole 421, this state is defined as a free state of the locking assembly 400. Referring to FIG. 13, the lock core 430 is clamped with the rack 450, and the indoor connecting box 310 and the outdoor connecting box 320 cannot move away from each other and can only move towards each other under the action of an external force, that is, at this time, the connecting part 300 cannot be extended and can only be shortened under the action of an external force, so as to realize the locking of the connecting part 400.

When the indoor connecting box 310 is disposed on the outer side of the outdoor connecting box 320, the lock sleeve 420 is connected with the indoor connecting box 310, and the rack 450 is connected with the outdoor connecting box 320. When the indoor connecting box 310 is disposed on the inner side of the outdoor connecting box 320, the lock sleeve 420 is connected with the outdoor connecting box 320, and the rack 450 is connected with the indoor connecting box 310. In the present embodiment, the indoor connecting box 310 located on the outer side of the outdoor connecting box 320 is taken as an example for illustration.

Figure 7:
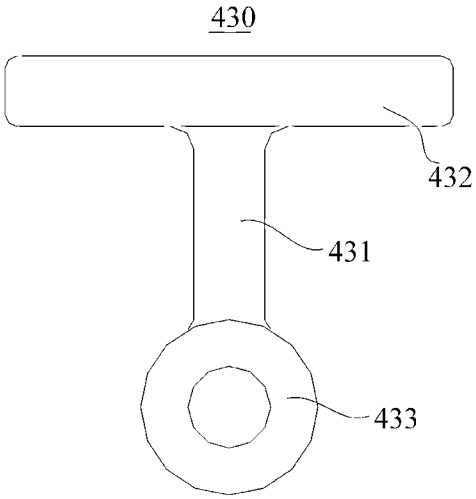
FIG. 7 is a schematic structural side view of an embodiment of a lock core according to the present invention.

FIG. 4 and FIG. 7 show schematic structural views of the lock core 430. FIG. 7 is a side view of the lock core 430 in a direction observed from a second end 4332 of the rack clamping part. The lock core 430 includes a lock pillar 431 and a push button connecting part 432 and a rack clamping part 433 that are respectively disposed at the upper and lower ends of the lock pillar 431. The push button connecting part 432 is configured to be connected with a push button 410, and the rack clamping part 433 is configured to be clamped with a rack 450. In the present embodiment, the push button connecting part 432 is a flat plate structure, and it is provided with openings 4321 configured to be clamped with the push button 410. The rack clamping part 433 includes a first end 4331 of the rack clamping part and a second end 4332 of the rack clamping part. The first end 4331 of the rack clamping part is a cylindrical structure and is configured to be clamped with the rack 450. The second end 4332 of the rack clamping part is also a cylindrical structure and is configured to be adapted to the lock sleeve 420.

Figure 8:
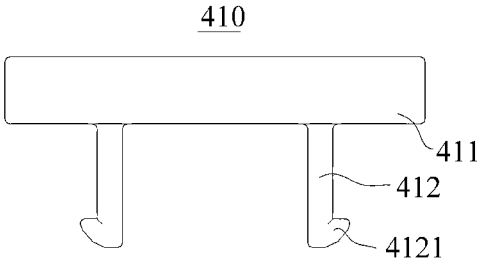
FIG. 8 is a schematic structural side view of a push button according to the present invention.

FIG. 4 and FIG. 8 show schematic structural views of the push button 410. The push button 410 includes a hand push part 411 and insertion parts 412. The hand push part 411 is a flat plate structure for a user to push by hand. Preferably, the upper surface of the hand push part 411 is provided with a plurality of ribs disposed at an interval to increase the friction force and facilitate the user operation. Clamping hooks 4121 are disposed at the free ends of the insertion parts 412, the insertion parts 412 are inserted into the openings 4321, and the clamping hooks 4121 are clamped with the openings 4321 so as to connect the push button 410 and the lock core 430 into a whole.

Figure 10:
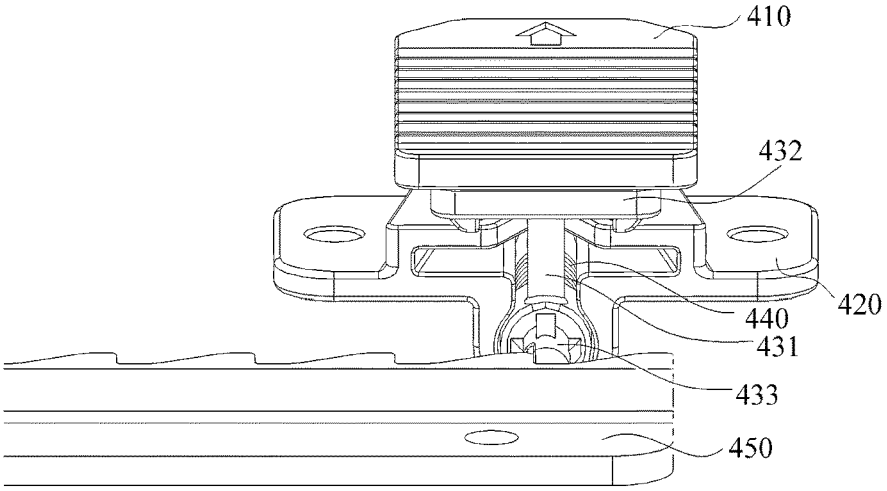
FIG. 10 is schematic structural view I of an embodiment of a locking assembly according to the present invention.

The upper surface of the decorative cover 340 is provided with through holes 341. When the locking assembly 400 is installed, the lock core 430 is located on the inner side of the decorative cover 340, the openings 4321 on the push button connecting part 432 are directly opposite to the through holes 341, the insertion parts 412 pass through the through holes 341, the clamping hooks 4121 are clamped with the openings 4321, and the hand push part 411 is located on the outer side of the decorative cover 340, referring to FIG. 10 and FIG. 11. Preferably, the lower surface of the hand push part 411 is attached to the outer surface of the decorative cover 340, and the upper surface of the push button connecting part 432 is attached to the inner surface of the decorative cover 340. When the hand push part 411 is pushed, the hand push part 411 drives the lock core 430 to slide along the decorative cover 340, so that the overall movement mechanism is more stable and not easy to shake.

As a preferred embodiment, the number of openings 4321 is two, and insertion parts 412 are correspondingly provided as two, so that the connection between the push button 410 and the lock core 430 is more reliable and the movement is more stable.

Figure 11:
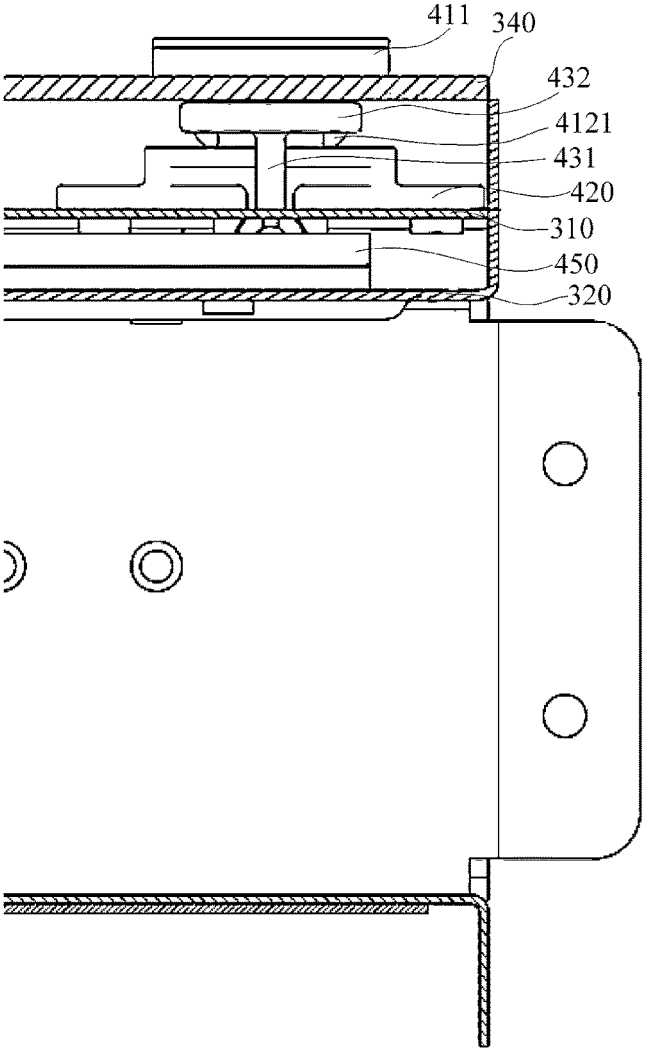
FIG. 11 is schematic structural view II of an embodiment of a locking assembly according to the present invention.

As a preferred embodiment, referring to FIG. 11, the lower end surfaces of the clamping hooks 4121 abut against the upper surface of the lock sleeve 420, so that the lock sleeve 420 plays a certain role in carrying the push button 410 to prevent the push button 410 from generating a displacement downward after being pressed by force, thereby causing the decorative cover 340 to be deformed under the force and affecting the smoothness of the movement of the locking assembly 400.

Figure 5:
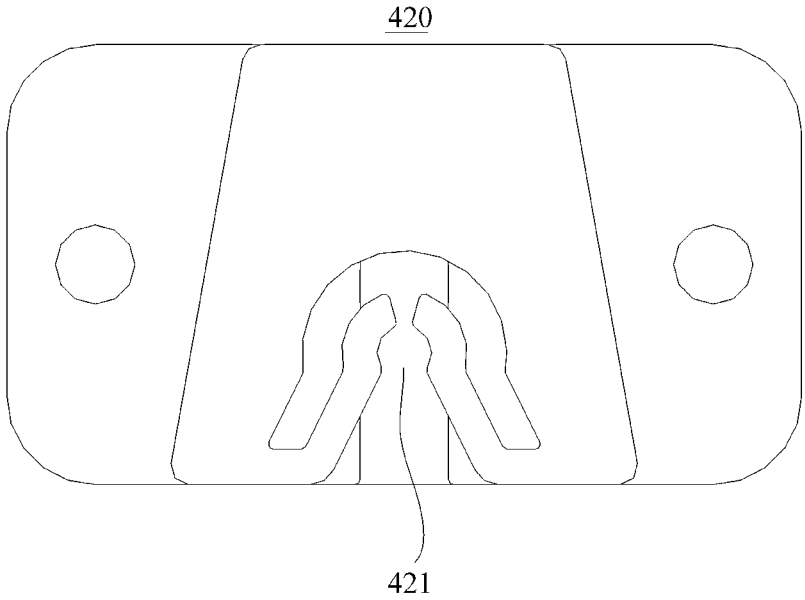
FIG. 5 is a schematic structural top view of an embodiment of a lock sleeve according to the present invention.
Figure 6:
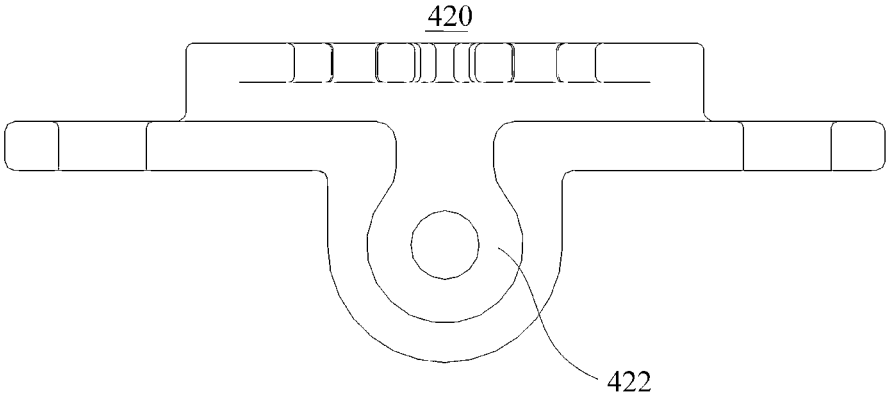
FIG. 6 is a schematic structural side view of an embodiment of a lock sleeve according to the present invention.

FIG. 3 to FIG. 6 show schematic structural views of the lock sleeve 420. FIG. 5 is a side view of the lock sleeve 420 in a direction observed from one side close to the lock hole 421. The lock sleeve 420 further includes a lock core accommodating cavity 422 communicated with the lock hole 421. When the lock pillar 431 is clamped and locked with the lock hole 421, the second end 4332 of the rack clamping part is disposed in the lock core accommodating cavity 422. Specifically, the lock sleeve 420 is fixedly installed on the outer side surface of the indoor connecting box 310 by screws, the indoor connecting box 310 is provided with an opening'(not shown) for the lock core accommodating cavity 422 to penetrate into, and the lock core accommodating cavity 422 passes through the opening'. The lock pillar 431 is located at the opening', and the lock pillar 431 is clamped with or separated from the lock hole 421 through the push of the push button 410. The rack clamping part 433 is located between the indoor connecting box 310 and the outdoor connecting box 320.

As a preferred embodiment, a spring 440 is disposed in the lock core accommodating cavity 422. When the matching relationship between the lock pillar 431 and the lock hole 421 changes from a clamped state to a separated state, the spring 440 plays a role in resetting the lock core 430. In addition, when the locking assembly 400 is in a free state, referring to FIG. 13, under the action of the spring 400, the first end 4331 of the rack clamping part always maintains the state of clamping with the rack 450.

The rack 450 is fixedly installed on the upper surface of the outdoor connecting box 320 by screws, and the rack 450 is arranged along the length direction of the outdoor connecting box (that is, the length direction L of the connecting part). The rack 450 has a plurality of saw teeth 451 arranged in sequence, each of the saw teeth 451 includes a stop part 4511 and an arc part 4512, and the arc part 4512 is closer to the outdoor part 100 than the stop part 4511. When the locking assembly 400 is in a free state, the first end 4331 of the rack clamping part abuts against the stop part 4511, so that the connecting part 300 cannot be further extended, that is, the indoor connecting box 310 and the outdoor connecting box 320 cannot move away from each other. When an external force acts on the indoor connecting box 310 or the outdoor connecting box 320 to drive the indoor connecting box and the outdoor connecting box to move towards each other, the first end 4331 of the rack clamping part moves along the arc part 4512 in a direction away from the stop part 4511, so that the length of the connecting part 300 is shortened.

As a preferred embodiment, the first end 4331 of the rack clamping part is provided with a plane part 4333, and the plane part 4333 abuts against the stop part 4511, so that the connection between the lock core 130 and the rack 450 is more reliable and stable during clamping.

Two locking assemblies 400 are provided and are arranged at an interval along the width direction W of the connecting part, which helps to improve the reliability.

When the saddle-type window air conditioner is installed, the steps are as follows:

the push button 410 is pushed to enable the lock sleeve 420 and the lock core 430 to be in a locked state, the first end 4331 of the rack clamping part is separated from the rack 450, and the connecting part 300 is stretched to the longest size;

the push button 410 is pushed to enable the lock sleeve 420 and the lock core 430 to be in a free state, the first end 4331 of the rack clamping part abuts against the rack 450, and the window type air conditioner is moved onto a windowsill; and the connecting part 300 cannot be further extended under the action of the spring 440, and the connecting part 300 is shortened to a suitable size according to the size of the windowsill, thereby completing the installation. By means of the locking assemblies 400, the installed window type air conditioner is not easy to shake and has strong reliability.

One end of the outdoor connecting box 320 close to the outdoor part 100 is provided with flangings 321, and the flangings 321 are fixedly connected with the outdoor part 100 by screws.

It should be illustrated finally that, the above embodiments are only used for illustrating the technical solutions of the present invention, and are not intended to limit the present invention. Although the present invention is illustrated in detail with reference to the foregoing embodiments, it should be understood by those skilled in the art that, modifications may still be made on the technical solutions recited in the foregoing embodiments, or equivalent replacements are made on part of the technical features; and these modifications or replacements do not make the essence of the corresponding technical solutions break away from the spirit and scope of the technical solution of the various embodiments of the present invention.

The invention claimed is:

1. A saddle-type window air conditioner, comprising an indoor part located on an indoor side, an outdoor part located on an outdoor side, and a connecting part disposed between the indoor part and the outdoor part, wherein the connecting part comprises an indoor connecting box and an outdoor connecting box sleeved in each other, the indoor connecting box is connected with the indoor part, the outdoor connecting box is connected with the outdoor part, and the indoor connecting box and the outdoor connecting box move relative to each other;

the saddle-type window air conditioner further comprises locking assemblies, wherein each of the locking assemblies comprises:

a lock sleeve, disposed on the indoor connecting box or on the outdoor connecting box, located on an outer side thereof, and provided with a lock hole;

a lock core, provided with a lock pillar clamped and locked with the lock hole;

a push button, connected with the lock core and configured to push the lock core to move; and a rack, disposed on the outdoor connecting box when the lock sleeve is disposed on the indoor connecting box or on the indoor connecting box when the lock sleeve is disposed on the outdoor connecting box, located on an inner side thereof;

when the lock pillar is clamped and locked with the lock hole, the lock core is separated from the rack; and when the lock pillar is separated from the lock hole, the lock core is clamped with the rack.

2. The saddle-type window air conditioner according to claim 1, wherein the lock core further comprises a push button connecting part and a rack clamping part respectively disposed at two ends of the lock pillar, the push button connecting part is connected with the push button, and the rack clamping part is clamped with the rack.

3. The saddle-type window air conditioner according to claim 2, wherein the push button connecting part is provided with openings; and the push button comprises a hand push part and insertion parts, clamping hooks are disposed at free ends of the insertion parts, the insertion parts are inserted into the openings, and the clamping hooks are clamped with the openings.

4. The saddle-type window air conditioner according to claim 3, wherein the clamping hooks abut against the lock sleeve.

5. The saddle-type window air conditioner according to claim 2, wherein the rack clamping part is provided with a plane part, and the plane part abuts against the rack.

6. The saddle-type window air conditioner according to claim 5, wherein the rack has a plurality of saw teeth arranged in sequence, each of the saw teeth comprises a stop part and an arc part, and the plane part abuts against the stop part.

7. The saddle-type window air conditioner according to claim 2, wherein the lock sleeve further comprises a lock core accommodating cavity communicated with the lock hole, and when the lock pillar is clamped and locked with the lock hole, one end of the rack clamping part is disposed in the lock core accommodating cavity.

8. The saddle-type window air conditioner according to claim 7, wherein a spring is further disposed in the lock core accommodating cavity.

9. The saddle-type window air conditioner according to claim 3, wherein the connecting part further comprises a decorative cover, the decorative cover is connected with the indoor part and is provided with through holes, the insertion parts pass through the through holes and are clamped with the openings, and the hand push part is located on an outer side of the decorative cover.

10. The saddle-type window air conditioner according to claim 9, wherein two locking assemblies are provided and are arranged at an interval along a width direction of the connecting part.

11. The saddle-type window air conditioner according to claim 1, wherein, when the indoor connecting box is sleeved on the outer side of the outdoor connecting box:

the lock sleeve is disposed on the outer side of the indoor connecting box, and the rack is disposed on the inner side of the outdoor connecting box.

12. The saddle-type window air conditioner according to claim 1, wherein, when the indoor connecting box is sleeved on the inner side of the outdoor connecting box:

the lock sleeve is disposed on the outer side of the outdoor connecting box, and the rack is disposed on the inner side of the indoor connecting box.

* * * * *